US011170680B2

(12) United States Patent
Lv et al.

(10) Patent No.: US 11,170,680 B2
(45) Date of Patent: Nov. 9, 2021

(54) METHOD AND APPARATUS FOR ACQUIRING MURA COMPENSATION DATA, COMPUTER DEVICE AND STORAGE MEDIUM

(71) Applicant: Kunshan Go-Visionox Opto-Electronics Co., Ltd., Kunshan (CN)

(72) Inventors: Xiaodi Lv, Kunshan (CN); Xiaobao Zhang, Kunshan (CN); Jinquan Zhang, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 16/735,726

(22) Filed: Jan. 7, 2020

(65) Prior Publication Data

US 2020/0143726 A1 May 7, 2020

Related U.S. Application Data

(63) Continuation of application No. PCT/CN2019/085302, filed on Apr. 30, 2019.

(30) Foreign Application Priority Data

Jul. 25, 2018 (CN) ..... 201810823625.6

(51) Int. Cl.
*G09G 3/16* (2006.01)
*G09G 3/20* (2006.01)

(52) U.S. Cl.
CPC ..... *G09G 3/16* (2013.01); *G09G 3/2092* (2013.01); *G09G 2320/0626* (2013.01); *G09G 2320/0686* (2013.01); *G09G 2340/02* (2013.01)

(58) Field of Classification Search
CPC ..... G09G 3/16–20; G09G 3/2092; G09G 3/2096; G09G 3/3233–3258;
(Continued)

(56) References Cited

U.S. PATENT DOCUMENTS 9,601,060 B2 3/2017 Gyu
2008/0284794 A1 11/2008 Wang et al.
(Continued)

FOREIGN PATENT DOCUMENTS

CN 101640038 A 2/2010
CN 103500566 A 1/2014
(Continued)

OTHER PUBLICATIONS

Office Action of Chinese Patent Application No. 2018108236256 dated Apr. 20, 2020.
(Continued)

*Primary Examiner* — Nathan Danielsen
(74) *Attorney, Agent, or Firm* — Kilpatrick Townsend & Stockton

(57) ABSTRACT

The present disclosure relates to a method and an apparatus for acquiring Mura compensation data, a computer device and a storage medium, in which one or more Mura areas in a display panel are determined according to brightness data of a detection picture, and one or more Mura areas in the display panel are graded, and then compensation data of the display panel is determined according to the Mura level and the brightness data of the detection picture.

6 Claims, 10 Drawing Sheets

(58) Field of Classification Search
CPC ..... G09G 3/3275–3291; G09G 3/3406–3426; G09G 3/3685–3692; G09G 2310/027–0275; G09G 2310/04; G09G 2320/02; G09G 2320/0233; G09G 2320/0271; G09G 2320/0276; G09G 2320/0285–0295; G09G 2320/0626–0646; G09G 2320/0686; G09G 2340/02
See application file for complete search history.

(56) References Cited

U.S. PATENT DOCUMENTS

| | | | | |
|---|---|---|---|---|
| 2009/0051907 | A1 | 2/2009 | Li | |
| 2015/0070403 | A1* | 3/2015 | Kim | G09G 3/20 345/690 |
| 2016/0011121 | A1* | 1/2016 | Tomioka | H04N 17/04 348/128 |
| 2017/0243562 | A1* | 8/2017 | Hu | G09G 3/2092 |
| 2017/0347098 | A1* | 11/2017 | Gilmutdinov | G09G 3/3233 |
| 2018/0191371 | A1* | 7/2018 | Tao | G09G 3/36 |
| 2019/0132001 | A1 | 5/2019 | Deng et al. | |
| 2019/0266968 | A1 | 8/2019 | Wang | |

FOREIGN PATENT DOCUMENTS

| | | | |
|---|---|---|---|
| CN | 103792699 | A | 5/2014 |
| CN | 104021774 | A | 9/2014 |
| CN | 105096875 | A | 11/2015 |
| CN | 105590604 | A | 5/2016 |
| CN | 105632443 | A | 6/2016 |
| CN | 106328053 | A | 1/2017 |
| CN | 106339196 | A | 1/2017 |
| CN | 106531050 | A | 3/2017 |
| CN | 106910483 | A | 6/2017 |
| CN | 106952626 | A | 7/2017 |
| CN | 107045863 | A | 8/2017 |
| CN | 107180605 | A | 9/2017 |
| CN | 107240384 | A | 10/2017 |
| CN | 107689214 | A | 2/2018 |
| CN | 107749288 | A | 3/2018 |
| CN | 107799065 | A | 3/2018 |
| CN | 107845087 | A | 3/2018 |
| CN | 108877740 | A | 11/2018 |
| WO | 2015043178 | A1 | 4/2015 |
| WO | 2017152457 | A1 | 9/2017 |
| WO | 2018040463 | A1 | 3/2018 |
| WO | 2018201535 | A1 | 11/2018 |
| WO | 2019113791 | A1 | 6/2019 |

OTHER PUBLICATIONS

CN First Office Action with search report dated Sep. 26, 2019 in the corresponding CN application (application No. 201810823625.6).

* cited by examiner

| | A | B | C | D | E | F | G | H | I | J | K | L | M |
|---|---|---|---|---|---|---|---|---|---|---|---|---|---|
| 527 | 12.202 | 13.839 | 14.057 | 13.79 | 13.604 | 13.905 | 13.092 | 13.789 | 13.749 | 13.282 | 13.182 | 13.711 | 13.19 |
| 528 | 13.95 | 14.54 | 14.461 | 15.633 | 14.264 | 14.899 | 13.683 | 13.197 | 13.98 | 14.525 | 13.933 | 14.262 | 14.32 |
| 529 | 11.691 | 15.028 | 13.614 | 13.522 | 13.637 | 14.187 | 14.179 | 13.952 | 12.738 | 13.416 | 13.843 | 14.233 | 14.02 |
| 530 | 14.294 | 14.244 | 14.089 | 13.904 | 14.026 | 13.146 | 13.674 | 14.482 | 14.164 | 14.997 | 14.664 | 13.965 | 14.02 |
| 531 | 12.841 | 14.078 | 14.082 | 13.53 | 13.742 | 13.098 | 13.489 | 13.42 | 14.383 | 12.985 | 13.596 | 13.4 | 13.65 |
| 532 | 14.323 | 14.234 | 13.899 | 14.252 | 13.43 | 12.494 | 14.47 | 13.017 | 12.797 | 13.789 | 13.859 | 15.268 | 13.75 |
| 533 | 12.801 | 12.999 | 14.171 | 13.305 | 13.119 | 14.565 | 13.035 | 13.486 | 13.07 | 14.048 | 13.4 | 13.815 | 12.96 |
| 534 | 14.636 | 14.32 | 13.681 | 13.381 | 13.884 | 14.18 | 13.825 | 14.761 | 15.381 | 14.071 | 13.827 | 14.626 | 14.57 |
| 535 | 13.162 | 13.051 | 13.427 | 14.979 | 13.605 | 14.48 | 12.547 | 13.717 | 12.763 | 13.356 | 13.326 | 13.419 | 14.25 |
| 536 | 14.363 | 14.475 | 15.177 | 14.4 | 14.873 | 14.52 | 13.914 | 14.748 | 14.176 | 14.515 | 14.237 | 13.468 | 14.44 |
| 537 | 13.51 | 13.138 | 13.874 | 12.858 | 14.873 | 14.642 | 13.106 | 13.896 | 13.911 | 14.15 | 13.3 | 13.23 | 13.51 |
| 538 | 13.724 | 13.651 | 14.002 | 14.402 | 14.259 | 14.854 | 14.311 | 15.23 | 14.748 | 13.962 | 14.433 | 14.125 | 14.70 |
| 539 | 12.379 | 13.891 | 13.742 | 13.844 | 12.95 | 13.455 | 12.481 | 13.064 | 14.204 | 13.322 | 13.839 | 13.121 | 12.80 |
| 540 | 13.451 | 14.788 | 14.623 | 15.397 | 14.719 | 14.686 | 15.529 | 14.476 | 14.349 | 14.498 | 14.05 | 14.271 | 14.86 |
| 541 | 13.456 | 13.6 | 14.38 | 13.804 | 13.986 | 14.031 | 12.648 | 13.353 | 13.45 | 13.348 | 13.398 | 13.873 | 13.32 |
| 542 | 14.306 | 14.864 | 15.274 | 13.412 | 14.81 | 15.209 | 15.089 | 15.445 | 13.685 | 14.337 | 13.118 | 14.072 | 15.02 |
| 543 | 12.065 | 13.229 | 13.901 | 13.53 | 13.058 | 13.076 | 13.655 | 14.259 | 13.003 | 13.675 | 13.538 | 12.409 | 14.01 |
| 544 | 13.873 | 16.121 | 15.399 | 16.11 | 15.711 | 13.799 | 13.683 | 14.652 | 14.066 | 14.285 | 14.228 | 14.682 | 14.67 |
| 545 | 12.767 | 13.878 | 13.34 | 13.485 | 13.024 | 13.024 | 13.98 | 13.179 | 12.891 | 14.135 | 13.446 | 13.169 | 12.48 |
| 546 | 15.894 | 15.399 | 15.353 | 14.766 | 15.379 | 15.27 | 14.166 | 14.164 | 13.202 | 14.586 | 14.464 | 15.633 | 14.23 |
| 547 | 12.123 | 12.768 | 13.882 | 12.175 | 13.898 | 13.101 | 14.167 | 13.607 | 13.58 | 13.538 | 13.811 | 12.91 | 13.61 |
| 548 | 14.747 | 14.004 | 14.675 | 14.18 | 14.596 | 14.242 | 14.01 | 14.936 | 14.134 | 16.801 | 14.114 | 15.517 | 14.18 |
| 549 | 13.366 | 13.166 | 14.319 | 14.324 | 13.499 | 13.143 | 13.203 | 13.261 | 13.833 | 13.126 | 13.744 | 14.904 | 13.59 |
| 550 | 13.309 | 14.251 | 14.211 | 13.837 | 14.079 | 13.59 | 14.189 | 14.963 | 14.957 | 14.275 | 14.152 | 15.206 | 13.45 |
| 551 | 12.445 | 14.497 | 14.224 | 13.641 | 14.365 | 13.761 | 13.569 | 13.428 | 13.624 | 13.8 | 13.976 | 13.825 | 13.3 |

FIG. 1c

METHOD AND APPARATUS FOR ACQUIRING MURA COMPENSATION DATA, COMPUTER DEVICE AND STORAGE MEDIUM

CROSS-REFERENCES TO RELATED APPLICATIONS

The present application is a continuation application of International Application No. PCT/CN2019/085302, filed on Apr. 30, 2019, which claims priority to Chinese Patent Disclosure No. 201810823625.6, filed on Jul. 25, 2018, entitled "Method and Apparatus for Acquiring Mura Compensation data, Computer Device and Storage Medium", the contents of which are herein incorporated by reference in their entirety.

TECHNICAL FIELD

The present disclosure relates to the display technology.

BACKGROUND

With the rapid development of video display technology, a display technology of a display panel with a large-size, an ultra-high resolution and an ultra-narrow bezel has become the focus of competition among panel manufacturers. However, conventional technology is inadequate, and new techniques are desired.

SUMMARY

In the various embodiments of the present disclosure, a method and an apparatus for acquiring Mura compensation data, a computer device and a storage medium are provided.

In an exemplary embodiment of the present disclosure, a method for acquiring Mura compensation data is provided, including: acquiring brightness data of a detection picture displayed by a display panel; determining one or more Mura areas in the display panel according to the brightness data of the detection picture; determining a Mura level respectively corresponding to each of the one or more Mura areas according to the brightness data corresponding to the one or more Mura areas and a preset Mura level threshold; generating compensation data corresponding to the display panel according to the Mura level respectively corresponding to each of the one or more Mura areas, the brightness data of the detection picture, and preset target brightness data.

In an embodiment, the determining the one or more Mura areas in the display panel according to the brightness data of the detection picture includes: obtaining a brightness average value corresponding to the detection picture by calculation according to the brightness data of the detection picture; determining the one or more Mura areas in the display panel according to the brightness data and the brightness average value.

In an embodiment, the determining the one or more Mura areas in the display panel according to the brightness data and the brightness average value includes: calculating a difference value between the brightness data and the brightness average value; determining the one or more Mura areas in the display panel according to the difference value.

In an embodiment, the determining the Mura level respectively corresponding to the each of the one or more Mura areas according to the brightness data corresponding to the one or more Mura areas and the preset Mura level threshold includes: determining the Mura level respectively corresponding to the each of the one or more Mura areas according to the difference value corresponding to the each of the one or more Mura areas and the preset Mura level threshold.

In an embodiment, the generating the compensation data corresponding to the display panel according to the Mura level respectively corresponding to the each of the one or more Mura areas, the brightness data of the detection picture, and the preset target brightness data includes: determining an algorithm corresponding to the each of the one or more Mura areas according to the Mura level respectively corresponding to the each of the one or more Mura areas; generating the compensation data corresponding to the display panel according to the algorithm, the brightness data of the detection picture, and the target brightness data.

In an embodiment, after the determining the algorithm corresponding to the each of the one or more Mura areas according to the Mura level respectively corresponding to the each of the one or more Mura areas, the method further includes: determining a compression ratio respectively corresponding to the each of the one or more Mura areas according to the Mura level and the algorithm respectively corresponding to the each of the one or more Mura areas.

In an embodiment, the generating the compensation data corresponding to the display panel according to the algorithm, the brightness data of the detection picture, and the target brightness data includes: generating the compensation data corresponding to the display panel according to the algorithm, the compression ratio, the brightness data of the detection picture, and the target brightness data.

In an embodiment, the greater the difference value between the brightness data of the each of the one or more Mura areas and the brightness average value, the higher the corresponding Mura level.

In an embodiment, the compression ratio is negatively correlative with the Mura level corresponding to the each of the one or more Mura areas.

In another exemplary embodiment of the present disclosure, an apparatus for acquiring Mura compensation data is provided, including: a brightness data acquiring module, or called as a brightness data acquiring circuit, configured to acquire brightness data of a detection picture displayed by a display panel; a Mura area determining module, or called as a Mura area determining circuit, configured to determine one or more Mura areas in the display panel according to the brightness data of the detection picture; a Mura level determining module, or called as a Mura level determining circuit, configured to determine a Mura level respectively corresponding to each of the one or more Mura areas according to the brightness data corresponding to the one or more Mura areas and a preset Mura level threshold; a compensation data generating module, or called as a compensation data generating circuit, configured to generate compensation data corresponding to the display panel according to the Mura level respectively corresponding to the each of the one or more Mura areas, the brightness data of the detection picture, and preset target brightness data.

In another exemplary embodiment of the present disclosure, a computer device including a memory and a processor is provided, the memory stores computer programs which, when executed by the processor, cause the processor to implement steps of the method of any one of the above embodiments.

In another exemplary embodiment of the present disclosure, a computer readable storage medium is provided, on which computer programs are stored, the computer programs, when executed by a processor, cause the processor to implement steps of the method of any one of the above embodiments.

Through the above-mentioned method and apparatus for acquiring Mura compensation data, the computer device and the storage medium, one or more Mura areas in a display panel are determined according to brightness data of a detection picture, and the one or more Mura areas in the display panel are graded, and then the compensation data of the display panel is determined according to the Mura level and the brightness data of the detection picture. According to the Mura level of the Mura area in the display panel, different modes can be selected to generate more accurate compensation data, thereby solving the technical problem of worse display effect of the area with serious Mura caused by using the same one mode, and improving the display effect of the display panel.

BRIEF DESCRIPTION OF THE DRAWINGS

FIG. 1*c* shows brightness data corresponding to a display panel in an exemplary embodiment;

DETAILED DESCRIPTION OF THE INVENTION

Figure 1A:
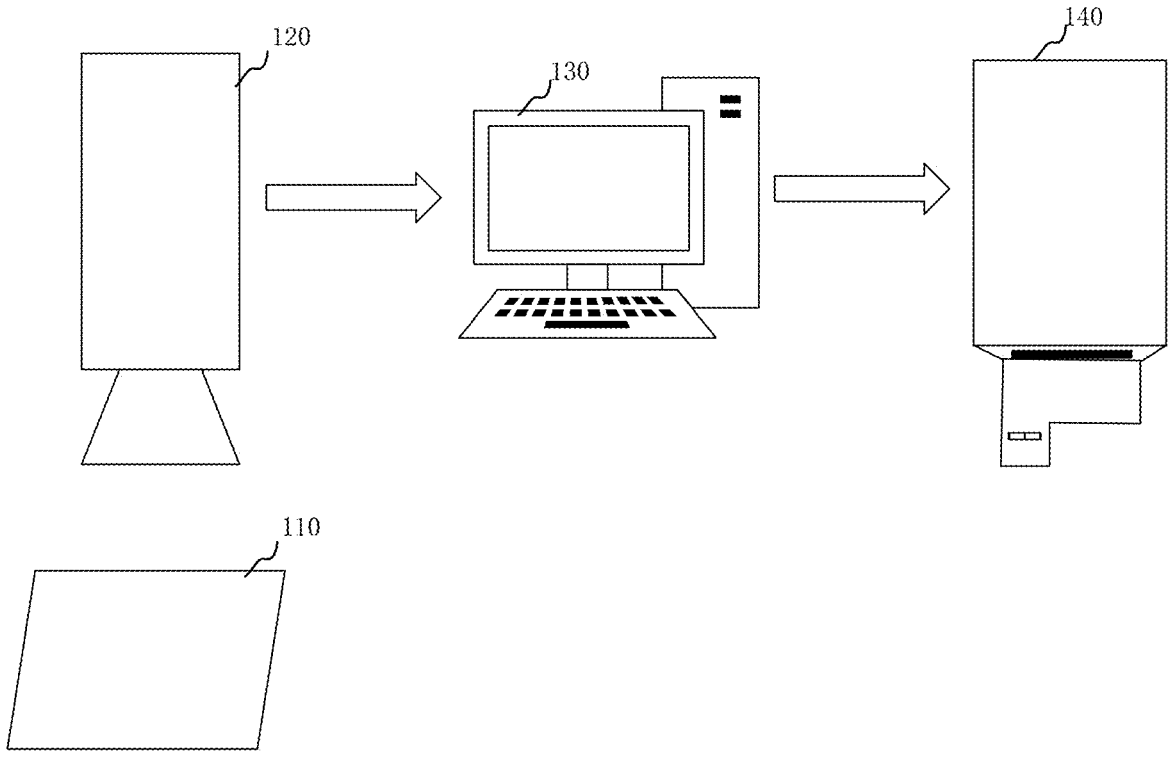
FIG. 1*a* is a schematic diagram of an application scenario for acquiring Mura compensation data in an exemplary embodiment.

As the size of a display panel increases, the difficulty in the process control of the display panel is increased, and the control deviation of manufacture process is liable to cause the picture uniformity to become worse and to produce Mura. The Mura refers to a non-uniform display phenomenon of the display panel, which is caused by factors such as the technological level, the purity of the raw materials and the like, and is a common technical problem in the field of display technology.

In order to compensate for the Mura phenomenon produced in the manufacture process, the brightness of each pixel in the display panel is generally corrected through a mode of brightness compensation, and then the Mura phenomenon is eliminated. However, in an area where the Mura is serious, the display effect becomes worse after the brightness compensation.

As described in the background art, in an area where the Mura is serious, after the brightness compensation, the display effect becomes worse. The inventor has found that the distribution of the Mura area is discrete for a display panel of a larger size. If the brightness data corresponding to a plurality of Mura areas is processed by using the same mode to generate the compensation data, after the brightness compensation for an area part of which has more serious Mura, the display effect of the display panel is more abnormal than before the compensation, that is, the brightness compensation results in a worse display effect. After research, the inventor has found that the root cause of production of such problem is that there is a large difference among the brightness data corresponding to the plurality of Mura areas in the display panel, that is, the severities of the plurality of Mura areas in the display panel are different. Mura areas with different severities require different processing modes. The plurality of Mura areas in the display panel are processed merely through the same one mode without using processing modes respectively suitable for various Mura areas in the display panel according to the actual conditions, resulting in worse display effect in an area with serious Mura.

Based on this, according to various exemplary embodiments of the present disclosure, a method for acquiring Mura compensation data is provided. Through the method, one or more Mura areas in a display panel are determined according to brightness data of a detection picture, and one or more Mura areas in the display panel are graded, and then the compensation data of the display panel is determined according to Mura levels of the Mura areas in the display panel and the brightness data of the detection picture. Through selecting different modes to generate more accurate compensation data, the technical problem of worse display effect of the area with serious Mura caused by using the same one mode is solved, and the display effect of the display panel is improved.

In order to make the above objectives, features and advantages of various exemplary embodiments disclosed herein clearer and more understandable, embodiments of the present disclosure will be described in detail below with reference to the accompanying drawings. The details are set forth in the following description in order to adequately understand the exemplary embodiments of the present disclosure. However, the exemplary embodiments of the present disclosure can be implemented in many other ways different from those described herein, and a person skilled in the art can make similar modifications without departing from the disclosure, and therefore, the present disclosure is not limited by the specific embodiments disclosed below.

The acquisition process of the Mura compensation data will be described below with reference to FIG. 1*a*. A connection is established between a data processing apparatus 130 and an image capturing apparatus 120. Image capturing apparatus 120 may be a CCD camera. First, the image capturing apparatus 120 performs image capture on the detection picture 110 to be displayed by the display panel 140 and extracts corresponding brightness data. Then, the image capturing apparatus 120 transmits the brightness data of the detection picture 110 to the data processing apparatus 130. The data processing apparatus 130 processes the brightness data of the detection picture 110 displayed by the display panel 140 to obtain compensation data corresponding to the detection picture 110. The obtained compensation data is burned into the flash internal memory of the display panel 140 to be compensated.

Figure 1B:
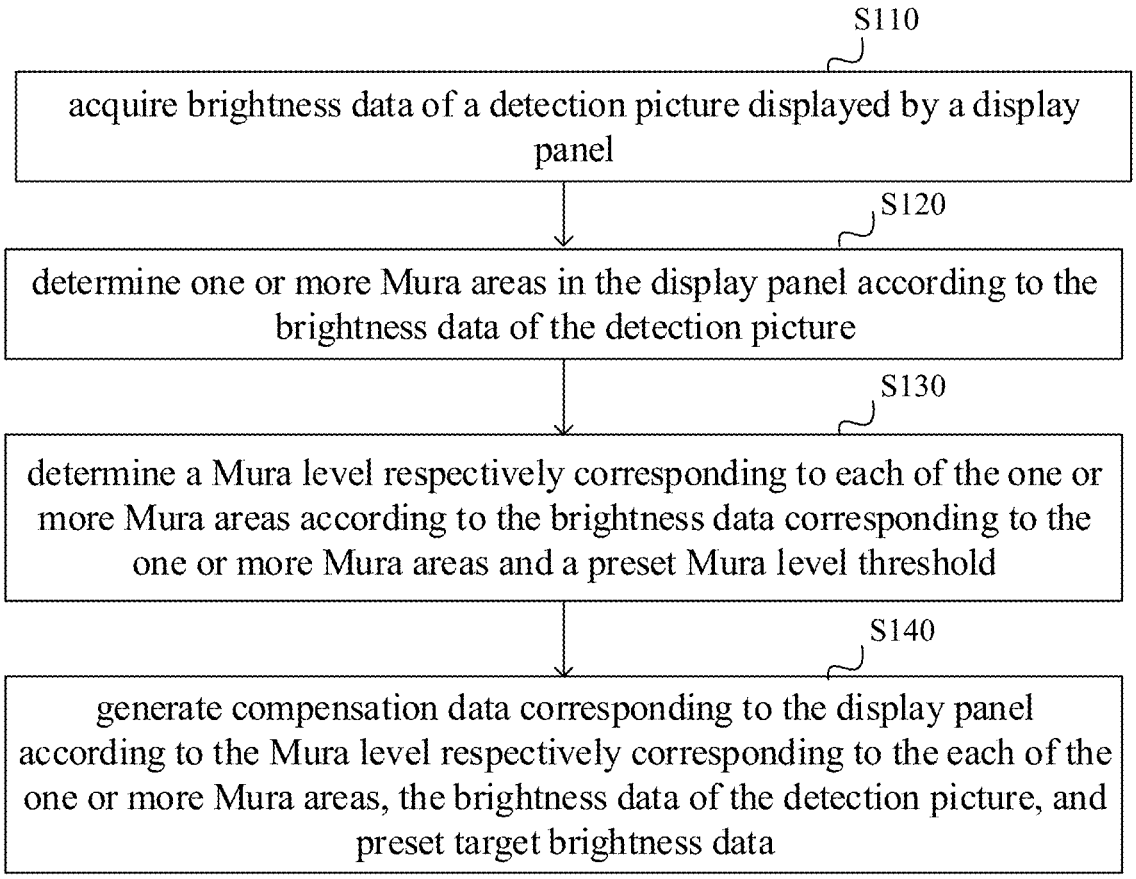
FIG. 1*b* is a schematic flow chart of acquiring Mura compensation data in an exemplary embodiment.

In an embodiment, referring to FIG. 1*b*, an exemplary embodiment of the present disclosure provides a method for acquiring Mura compensation data, which is applied to the data processing apparatus 130 in FIG. 1*a* as an example, the method includes the following steps.

Step S110: brightness data of a detection picture displayed by a display panel is acquired.

The display panel 140 may be, but not limited to, a plasma display panel, a liquid crystal display panel (LCD), a light emitting diode display panel (LED), or an organic light emitting diode display panel (OLED). The display panel 140 is provided with pixels arranged in an array. Each pixel includes three sub-pixels of red R, green G, and blue B. A light source of each sub-pixel may display different brightness level which is represented by a gray scale. The gray scale represents a hierarchical level of different brightness from darkest to brightest. The brightness data refers to the gray scale corresponding to the light-emitting display of each pixel in the display area.

Specifically, the display panel 140 displays the detection picture 110, and an image capturing apparatus 120 photographs the detection picture 110 to obtain an image of the detection picture 110 and extract the brightness data corresponding to the detection picture 110. Then, the brightness data corresponding to the detection picture 110 is transmitted to the data processing apparatus 130, that is, the data processing apparatus 130 acquires the brightness data of the detection picture 110 displayed by the display panel 140. For example, under a plurality of gray-scales, the display panel 140 displays a solid color gray-scale detection picture corresponding to any single primary color of the three primary colors RGB. The solid color gray-scale detection picture may be a red gray-scale picture, or a green gray-scale picture, or a blue gray-scale picture. The image capturing apparatus 120 respectively shoots the solid color gray-scale detection pictures of the three primary colors displayed by the display panel 140 and extracts the brightness data of the solid color gray-scale detection pictures of three primary colors, to acquire the brightness data of the detection picture 110 displayed by the display panel 140.

Step S120: one or more Mura areas in the display panel are determined according to the brightness data of the detection picture.

There are some non-uniformly displayed areas in the detection picture 110 displayed by the display panel 140, and these non-uniformly displayed areas can be referred to as Mura areas. Moreover, the number of the Mura areas in the display panel 140 is related to the actual production process. For example, the detection picture 110 displayed by the display panel 140 is preset with target brightness data. When the brightness data of the pixels in a certain area in the display panel 140 deviates from the preset target brightness data, that is, when the brightness data of the pixels in the certain area is higher than or lower than the preset target brightness data, the brightness of the display panel 140 is non-uniform, that is, this certain area is determined as a Mura area.

Specifically, the display panel 140 displays solid color gray-scale detection pictures respectively corresponding to the three primary colors RGB, and each solid color gray-scale detection picture is preset with target brightness data. The brightness data corresponding to the solid color gray-scale detection picture can be acquired through the image capturing apparatus 120. Generally, there is a difference between the brightness data corresponding to the Mura area in the display panel 140 and the preset target brightness data. The data processing apparatus 130 acquires the brightness data of the detection picture 110 displayed by the display panel 140. Referring to FIG. 1*c*, the brightness data of the display panel 140 includes a brightness value corresponding to each pixel in the display panel 140, that is, a position relationship of each brightness value in the brightness data in FIG. 1*c* corresponds to a relative position of each pixel in the display panel 140. In other words, a longitudinal direction of the table shown in FIG. 1*c* corresponds to a longitudinal direction of the display panel 140, and a horizontal direction of the table corresponds to a horizontal direction of the display panel 140. Accordingly, when the brightness data of the pixel in a certain area is higher or lower than the preset target brightness data, the Mura area in the display panel 140 can be determined according to the brightness data of the detection picture 110. The number of the Mura areas in the display panel 140 may be one, two or more. That is, there may be one or more Mura areas in the display panel 140.

Step S130: a Mura level respectively corresponding to each of one or more Mura areas is determined according to the brightness data corresponding to one or more Mura areas and a preset Mura level threshold.

There are one or more Mura areas in the display panel 140. When the number of Mura areas is multiple, the brightness data respectively corresponding to different Mura areas may be different. One or more Mura areas in the display panel 140 are graded according to Mura level thresholds set in advance, then each Mura area corresponds to one Mura level. The Mura level threshold is a threshold corresponding to each Mura level. The Mura level threshold and the Mura level may be set according to actual production conditions. For example, the Mura level is defined according to the degree to which the brightness data corresponding to the Mura area deviates from the target brightness data (for example, the ratio of the deviation difference value to the target brightness data, etc.), and the Mura level threshold is set according to the difference value between the brightness data corresponding to the Mura area and the target brightness data. In the actual production process, the actual brightness data displayed by a plurality of display panels 140 is measured under a preset gray scale, and the Mura level and the Mura level threshold are set according to the acquired multiple sets of actual brightness data and the target brightness data. Then, the Mura level and the Mura level threshold are optimized and adjusted according to the actual compensation effect.

Figure 1D:
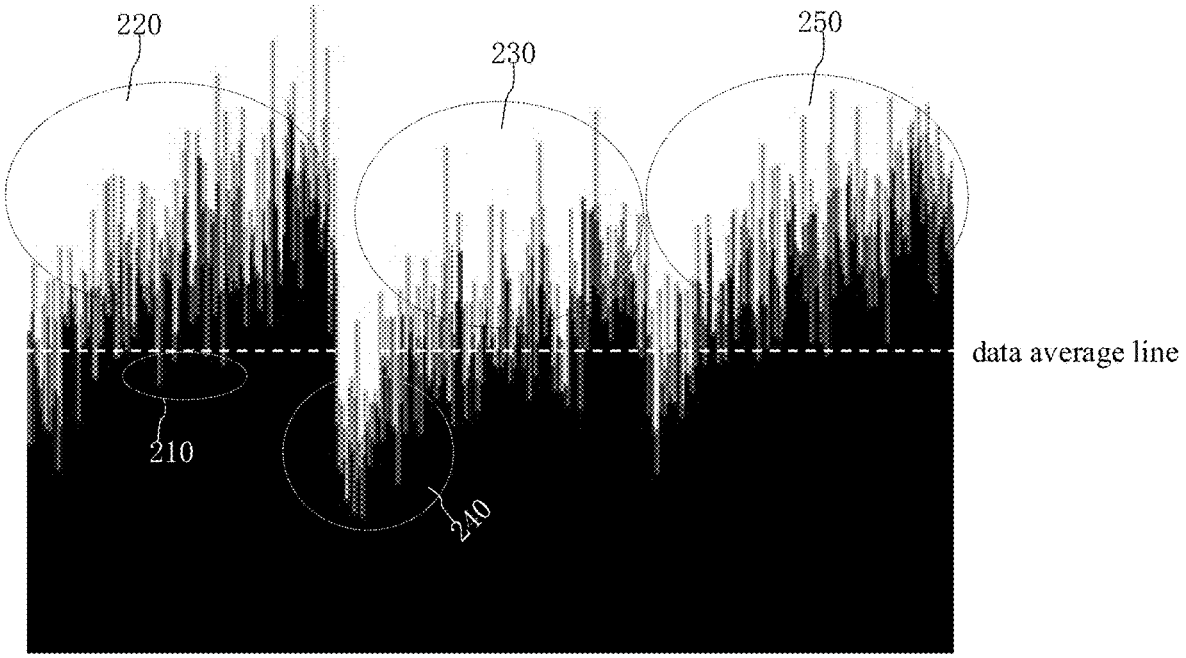
FIG. 1*d* shows discrete graphs of brightness data corresponding to a display panel in an exemplary embodiment.

Specifically, the data processing apparatus 130 determines the Mura area existing in the display panel 140 according to the brightness data of the detection picture 110 displayed by the display panel 140. Each Mura level is preset with a corresponding threshold, so that the Mura level corresponding to the Mura area in the display panel 140 is determined according to the brightness data corresponding to the Mura area in the display panel 140 and the Mura level threshold. The number of Mura areas in the display panel 140 is one or more. When the number of Mura areas in the display panel 140 is one, the Mura level corresponding to the Mura area is determined. When the number of Mura areas in the display panel 140 is more than one, the Mura levels respectively corresponding to the multiple Mura areas are determined. The Mura levels respectively corresponding to the multiple Mura areas may be the same one Mura level, or different Mura levels. For example, referring to FIG. 1*d*, FIG. 1*d* is a schematic diagram showing a comparison relationship between the brightness data of the detection picture 110 displayed by the display panel 140 and a data average value. The ordinate represents the brightness value, the abscissa represents the position of each pixel on the display panel 140, and the data average line represents an average value of the brightness data of the displayed detection picture 110. Continuing to refer to FIG. 1*d*, the Mura areas in the display panel 140 correspond to five Mura levels, namely a first Mura level 210, a second Mura level 220, a third Mura level 230, a fourth Mura level 240, and a fifth Mura level 250, respectively.

Step S140: compensation data corresponding to the display panel is generated according to the Mura level respectively corresponding to each Mura area, the brightness data of the detection picture, and the preset target brightness data.

There are one or more Mura areas in the display panel 140, and the data processing apparatus 130 determines the Mura level corresponding to the Mura area in the display panel 140 according to the brightness data corresponding to the Mura area in the display panel 140 and the Mura level threshold. When there are multiple Mura areas in the display panel 140, different Mura areas may correspond to the same Mura level, or respectively correspond to different Mura levels. When the multiple Mura areas in the display panel 140 correspond to the same Mura level, the brightness data of the detection picture 110 displayed by the display panel 140 is processed by using the same one mode according to the Mura level corresponding to the multiple Mura areas, to generate compensation data corresponding to the display panel 140. When the multiple Mura areas in the display panel 140 respectively correspond to different Mura levels, the brightness data corresponding to the multiple Mura areas are respectively processed by selecting different modes according to the Mura levels corresponding to the multiple Mura areas, to obtain the compensation data matching each of the Mura areas, that is, the compensation data corresponding to the display panel 140 is generated, thereby improving the display effect of the display panel 140.

In the present embodiment, one or more Mura areas in the display panel 140 are determined according to the brightness data of the detection picture 110, and the one or more Mura areas in the display panel 140 are graded, thus the compensation data of the display panel 140 are generated according to the Mura level, the brightness data of the detection picture 110 and the preset target brightness data, and then the selection of different modes of generating compensation data according to the Mura level of the Mura area in the display panel 140 is implemented, thereby ensuring the generation of more accurate compensation data, solving the technical problem of worse display effect of the area with serious Mura caused by using the same mode, and improving the display effect of the display panel.

Figure 2:
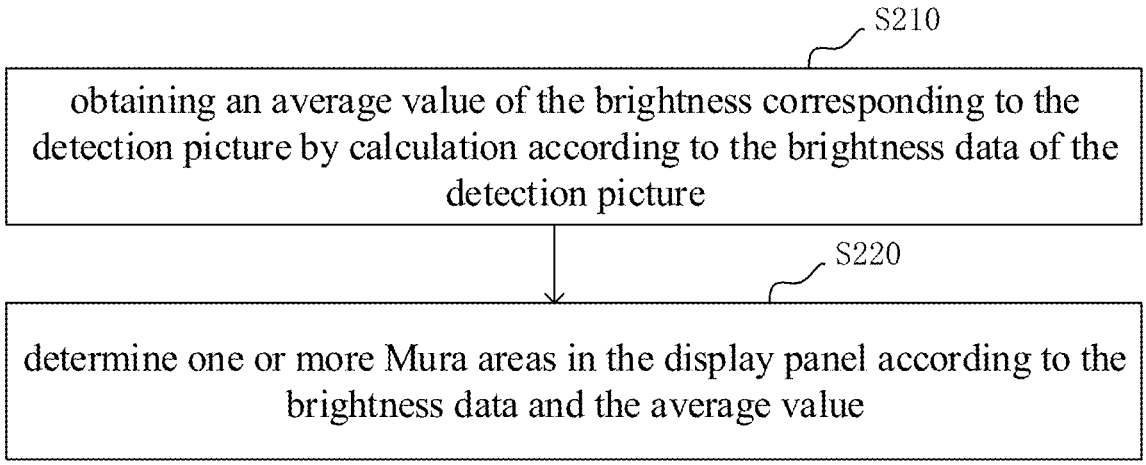
FIG. 2 is a schematic flow chart of a step S120 in FIG. 1*b;*

In an embodiment, referring to FIG. 2, the step of determining one or more Mura areas in the display panel according to the brightness data of the detection picture (i.e., step S120) includes the following steps:

step S210: an average value of the brightness corresponding to the detection picture is obtained by calculation according to the brightness data of the detection picture;

step S220: one or more Mura areas in the display panel are determined according to the brightness data and the average value.

The display panel 140 displays a solid color gray-scale detection picture corresponding to the three primary colors RGB, and the data processing apparatus 130 can acquire the brightness data of the detection picture 110 through the image capturing apparatus 120. Then, an average value corresponding to the brightness data of the detection picture 110 is obtained by calculation according to the brightness data of the detection picture 110. The brightness data corresponding to the Mura area of the detection picture 110 may deviate from the average value. Additionally, because the relative position of the brightness value of each pixel in the brightness data table corresponds to the relative position of each pixel displayed in the display panel 140, thereby the position of the Mura area in the display panel 140 can be determined. For example, the brightness data of the detection picture 110 is compared with the obtained average value, when the brightness data in a certain area deviates from the average value, the area can be determined as a Mura area in the display panel 140. The number of the Mura areas in the display panel 140 may be one, two or more, that is, there are one or more Mura areas in the display panel 140.

Figure 3:
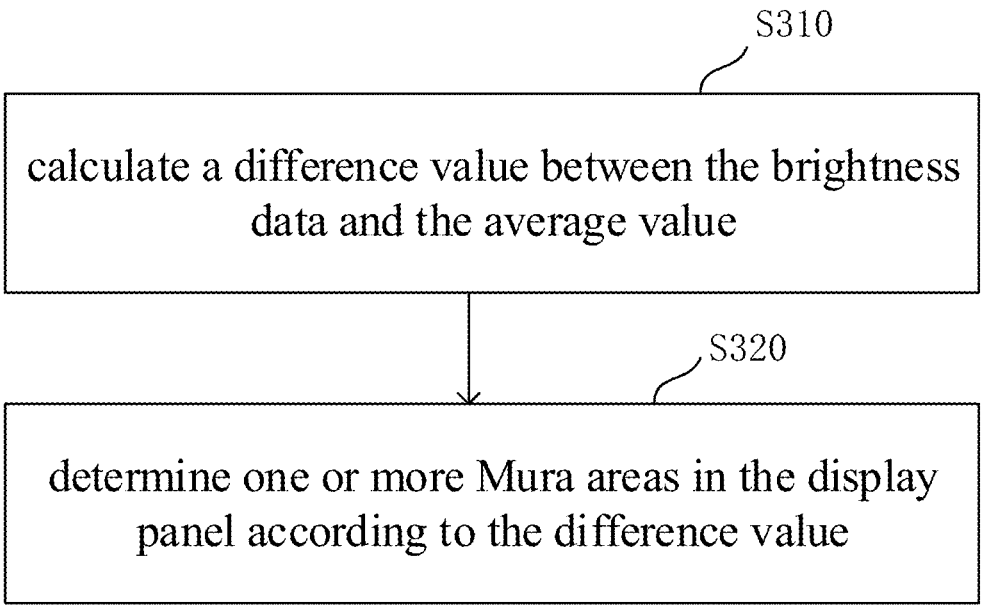
FIG. 3 is a schematic flow chart of a step S220 in FIG. 2.

In an embodiment, referring to FIG. 3, one or more Mura areas in the display panel are determined according to the brightness data of the detection picture and the average value of the brightness data (i.e., step S220) includes the following steps:

step S310: a difference value between the brightness data and the average value is calculated;

step S320: one or more Mura areas in the display panel are determined according to the difference value.

The display panel 140 displays a solid color gray-scale detection picture corresponding to the three primary colors RGB, and the data processing apparatus 130 may acquire the brightness data of the detection picture 110 through the image capturing apparatus 120. An average value corresponding to the brightness data of the detection picture 110 is obtained by calculation according to the brightness data of the detection picture 110. Then, a difference value between the brightness data of the detection picture 110 and the obtained average value is then calculated. And then, the Mura area in the display panel 140 can be determined according to the difference value between the brightness data of the detection picture 110 and the obtained average value. For example, when the difference value between the brightness data in a certain area of the display panel 140 and the obtained average value is greater than a preset threshold, the area can be determined as the Mura area in the display panel 140. The number of Mura areas in the display panel 140 may be one, two or more. That is, there may be one or more Mura areas in the display panel 140.

In an embodiment, the step of determining the Mura level respectively corresponding to each of one or more Mura areas according to the brightness data corresponding to one or more Mura areas and the preset Mura level threshold (i.e., step S130) specifically includes: the Mura level respectively corresponding to each of the one or more Mura areas is determined according to the difference value corresponding to one or more Mura areas and the preset Mura level threshold.

The Mura level threshold refers to a preset threshold corresponding to each Mura level. Specifically, the difference value between the brightness data of the detection picture 110 and the obtained average value includes a difference value corresponding to each of the Mura areas in the display panel 140. Since each Mura level is preset with a corresponding threshold, i.e., a Mura level threshold, the difference value corresponding to each Mura area in the display panel 140 may be compared with the Mura level threshold, and when the difference value corresponding to a certain Mura area in the display panel 140 is greater than the Mura level threshold, the Mura level corresponding to the Mura area can be determined.

In an embodiment, the corresponding average value is obtained by calculation according to the brightness data of the detection picture 110 displayed by the display panel 140; the Mura area in the display panel 140 is determined according to the difference value between the brightness data and the average value; and the Mura level corresponding to the Mura area is further determined according to the difference value and the preset Mura level threshold; finally, different modes are selected according to the Mura level of the Mura area in the display panel 140 to generate more accurate compensation data, thereby solving the technical problem of worse display effect of the area with serious Mura caused by using the same one mode, and improving the display effect of the display panel.

Figure 4:
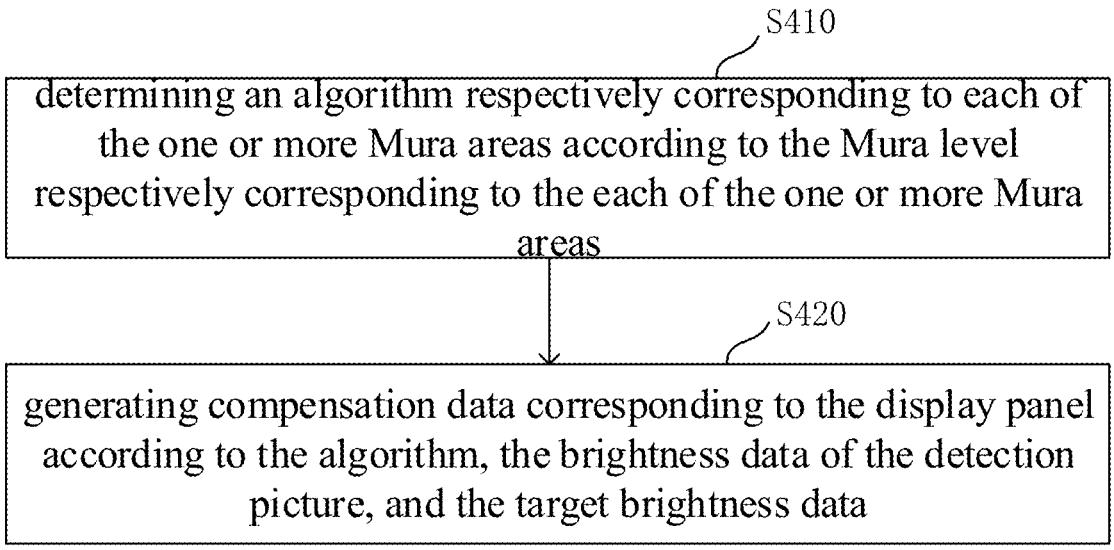
FIG. 4 is a schematic flow chart of a step S140 in FIG. 1*b;*

In an embodiment, referring to FIG. 4, the step of generating the compensation data corresponding to the display panel 140 according to the Mura level respectively corresponding to each of one or more Mura areas, the brightness data of the detection picture 110 and the preset target brightness data (i.e., step S140) may include the following steps:

step S410: an algorithm respectively corresponding to each of one or more Mura areas is determined according to the Mura level respectively corresponding to each of one or more Mura areas.

Step S420: compensation data corresponding to the display panel is generated according to the algorithm, the brightness data of the detection picture, and the target brightness data.

The above-mentioned algorithm refers to a method process for calculating compensation data according to the brightness data of the detection picture 110 and the target brightness data. Specifically, there are one or more Mura areas in the display panel 140, and the data processing apparatus 130 determines the Mura level corresponding to the Mura area in the display panel 140 according to the brightness data corresponding to the Mura area in the display panel 140 and the Mura level threshold. When there are multiple Mura areas, different Mura areas may correspond to the same Mura level, or correspond to different Mura levels.

When multiple Mura areas in the display panel 140 correspond to the same Mura level, the brightness data of the detection picture 110 displayed by the display panel 140 is calculated by using the same one algorithm according to the same one Mura level corresponding to the multiple Mura areas, to generate the compensation data corresponding to the display panel 140. When the multiple Mura areas in the display panel 140 correspond to different Mura levels, different algorithms are selected according to the Mura levels corresponding to the multiple Mura areas to respectively calculate the brightness data corresponding to the multiple Mura areas. Different algorithms are selected according to the Mura levels respectively corresponding to the Mura areas to obtain compensation data matching the multiple Mura areas, i.e., the compensation data corresponding to the display panel 140 is generated, thereby improving the display effect of the display panel 140.

For example, referring to FIG. 1*d*, a difference value between the brightness data corresponding to the first Mura level 210 and the average value, a difference value between the brightness data corresponding to the second Mura level 220 and the average value, a difference value between the brightness data corresponding to the third Mura level 230 and the average value, a difference value between the brightness data corresponding to the fourth Mura level 240 and the average value and a difference value between the brightness data corresponding to the fifth Mura level 250 and the average value, are different, that is, the first Mura level 210, the second Mura level 220, the third Mura level 230, the fourth Mura level 240, and the fifth Mura level 250 respectively correspond to different Mura levels. According to the first Mura level 210, the second Mura level 220, the third Mura level 230, the fourth Mura level 240, and the fifth Mura level 250, algorithms respectively corresponding to these levels are selected, that is, a corresponding algorithm is respectively determined according to the level corresponding to each of one or more Mura areas in the display panel 140. Specifically, the display panel 140 displays the solid color gray-scale image corresponding to the three primary colors RGB. The solid color gray-scale picture is preset with target brightness data, and the brightness data corresponding to the display panel 140 can be acquired through the image capturing apparatus 120. Then, the difference value between the preset target brightness data and the actually acquired brightness data is calculated. Accordingly, the difference value between the preset target brightness data and the actually acquired brightness data is processed according to the algorithm respectively corresponding to each of one or more Mura areas in the display panel 140, to generate compensation data corresponding to the display panel 140.

In the present embodiment, the corresponding algorithm is selected according to the Mura level of the Mura area in the display panel to generate more accurate compensation data, thereby solving the technical problem of worse display effect of the area with serious Mura caused by using the same one mode, and improving the display effect of the display panel.

Figure 5:
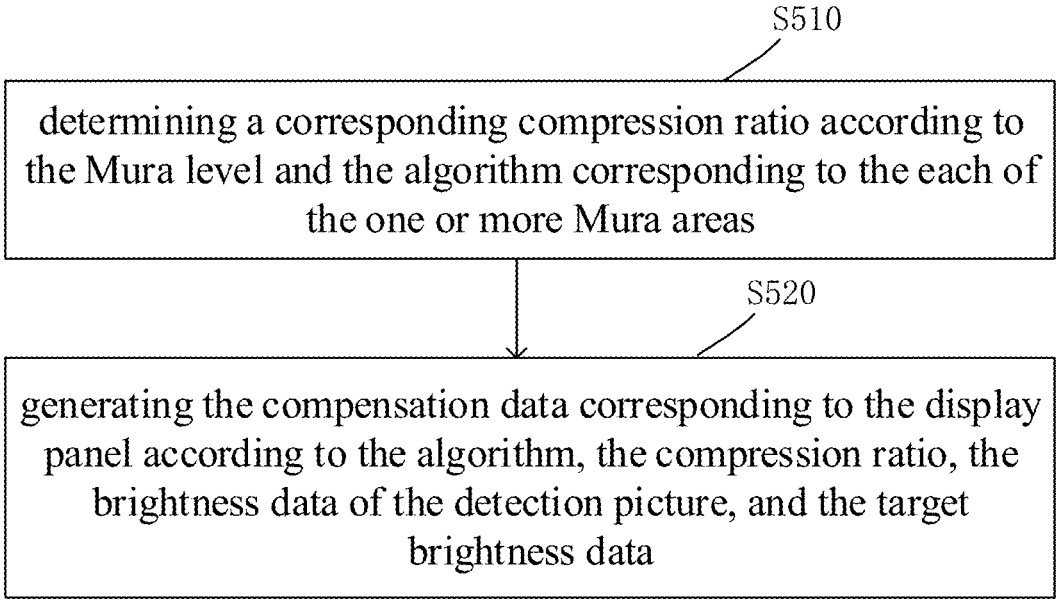
FIG. 5 is a schematic flow chart of step S140 in FIG. 1*b;*

In an embodiment, referring to FIG. 5, after the step of determining the algorithm respectively corresponding to each of one or more Mura areas according to the Mura level respectively corresponding to each of one or more Mura areas (i.e., step S410), the method further includes:

step S510: a corresponding compression ratio is determined according to the Mura level and the algorithm respectively corresponding to each of one or more Mura areas.

Referring to FIG. 5, the step of generating the compensation data corresponding to the display panel according to the algorithm, the brightness data of the detection picture and the target brightness data (i.e., step S420) may include:

step S520: the compensation data corresponding to the display panel is generated according to the algorithm, the compression ratio, the brightness data of the detection picture, and the target brightness data.

In general, in order to reduce the consumption of the storage space, the actually acquired brightness data is compressed by an n*m pixel area to generate compensation data, and the compensation data is stored in a Flash memory in the display panel 140, in which n*m is called the compression ratio. In the n*m pixel area, compensation data corresponding to one pixel in the n*m pixel area is selected to store. When performing compensation, the compensation data of each of the remaining pixels may be derived by linear interpolation calculation. For example, n=8, m=8, and the resolution of the display panel 140 is 1080*1920, that is, the display panel 140 has a total of 1080*1920 pixels. Through the compression of the 8*8 pixels area, a total of compensation data of 135*240 pixels are stored in the Flash memory. When performing the compensation, the IC chip of the display panel acquires compensation data of 135*240 pixels from the Flash memory, and obtains compensation data corresponding to 1080*1920 pixels by the linear interpolation calculation.

Specifically, there are one or more Mura areas in the display panel 140, and the data processing apparatus 130 determines the Mura level corresponding to the Mura area in the display panel 140 according to the brightness data corresponding to the Mura area in the display panel 140 and the Mura level threshold. The compression ratio in the algorithm is set according to the Mura level corresponding to the Mura area in the display panel 140. When multiple Mura areas in the display panel 140 correspond to the same Mura level, the brightness data of the detection picture 110 displayed by the display panel 140 is calculated with the same compression ratio according to the Mura level corresponding to the multiple Mura areas, to generate the compensation data corresponding to the display panel 140. When the multiple Mura areas in the display panel 140 respectively correspond to different Mura levels, different compression ratios are selected according to the Mura levels corresponding to the multiple Mura areas to respectively calculate the brightness data corresponding to the multiple Mura areas. Different compression ratios are selected according to the Mura levels corresponding to the Mura areas to obtain compensation data matching the multiple Mura areas, that is, compensation data corresponding to the display panel 140 is generated, thereby improving the display effect of the display panel 140.

For example, referring to FIG. 1*d*, the first Mura level 210, the second Mura level 220, the third Mura level 230, the fourth Mura level 240, and the fifth Mura level 250 respectively correspond to different Mura levels. According to the first Mura level 210, the second Mura level 220, the third Mura level 230, the fourth Mura level 240, and the fifth Mura level 250, the compression ratios in algorithms respectively corresponding to the first Mura level 210, the second Mura level 220, the third Mura level 230, the fourth Mura level 240, and the fifth Mura level 250 are determined respectively. Furthermore, a difference value between the preset target brightness data and the actually acquired brightness data is calculated, and then the compensation data corresponding to the display panel 140 is generated according to the difference value between the target brightness data and the actually acquired brightness data, the algorithms respectively corresponding to the multiple Mura areas in the display panel 140 and the compression ratios respectively corresponding to the algorithms.

In the present embodiment, the compression ratio in the algorithm is selected according to the Mura level of the Mura area in the display panel to generate more accurate compensation data, thereby solving the technical problem of worse display effect of the area with serious Mura caused by using the same compression ratio, and improving the display effect of the display panel.

In an embodiment, the greater the difference value between the brightness data of one Mura area of the one or more Mura areas and the average value, the more serious the degree of Mura, and the higher the corresponding Mura level. The compression ratio is negatively correlative with the Mura level corresponding to one or more Mura areas.

The degree of Mura refers to the degree of severity of non-uniform display phenomenon in the display panel. Specifically, referring to FIG. 1*d*, the data average line corresponds to the average value of the brightness data of the detection picture 110 displayed by the display panel 140. The brightness data corresponding to the first Mura level 210 in the display panel 140 deviates from the data average line least, and the brightness data corresponding to the second Mura level 220 deviates from the data average line most. Because the larger the difference value between the brightness data of the Mura area and the average value, and the higher the Mura level corresponding to the difference value between the brightness data of the Mura area and the average value, the second Mura level 220 is higher than the first Mura level. Additionally, because the compression ratio is negatively correlative with the Mura level corresponding to the Mura area, the compression ratio of the Mura area corresponding to the second Mura level 220 is smaller than the compression ratio of the Mura area corresponding to the first Mura level 210.

Exemplarily, referring to FIG. 1*d* again, because the first Mura level 210 is smaller than the second Mura level 220, the third Mura level 230, the fourth Mura level 240, and the fifth level 250, a larger compression ratio can be selected for the Mura area corresponding to the first Mura level 210 to compress the compensation data, for example, the compression ratio determined for the Mura area corresponding to the first Mura level 210 is 8*8. However, since the Mura area corresponding to the second Mura level 220 deviates from the data average line most, a smaller compression ratio is selected for the Mura area corresponding to the second Mura level 220 compress the compensation data, for example, the compression ratio of the Mura area corresponding to the second Mura level 220 is 2*2 or 4*4, so as to preserve the authenticity of the compensation data of the Mura area corresponding to the second Mura level 220 as much as possible, such that the display panel 140 is effectively compensated and the Mura phenomenon is eliminated.

When each Mura area in the display panel adopts the same compression ratio, if the compression ratio adopted is larger, the data corresponding to the area with more serious Mura may be more distorted, which accordingly makes the display effect worse. If the compression ratio adopted is smaller, the generated compensation data occupies a large storage space. However, in the present embodiment, different compression ratios are selected according to the Mura level corresponding to each Mura area. A smaller compression ratio is adopted for the area with more serious Mura to preserve the original data as much as possible, and a larger compression ratio is adopted for the area with slighter Mura to reduce the consumption of the storage space. Different compression ratios are adopted for different Mura levels, which avoids a problem that a large compression ratio may cause the data corresponding to the area with serious Mura to be more distorted, and also avoids the increase of the consumption of the storage space, thereby not only solving the technical problem of worse display effect of the area part of which has serious Mura caused by adopting the same compressor ratio, but also using the storage space reasonably.

Although the various steps in the flowchart of FIGS. 1-5 are sequentially displayed as indicated by the arrows, these steps are not necessarily performed in the order indicated by the arrows. Unless explicitly stated herein, the performing order of the steps is not be limited strictly, and the steps may be performed in other orders. Moreover, at least part of the steps in FIGS. 1-5 may comprise a plurality of sub-steps or phases, which are not necessary to be performed simultaneously, but may be performed at different time, and the performing order of these sub-steps or phases is not necessarily sequential, but may be performed by turns or alternately with other steps or sub-steps of other steps or at least part of the phases.

Figure 6:
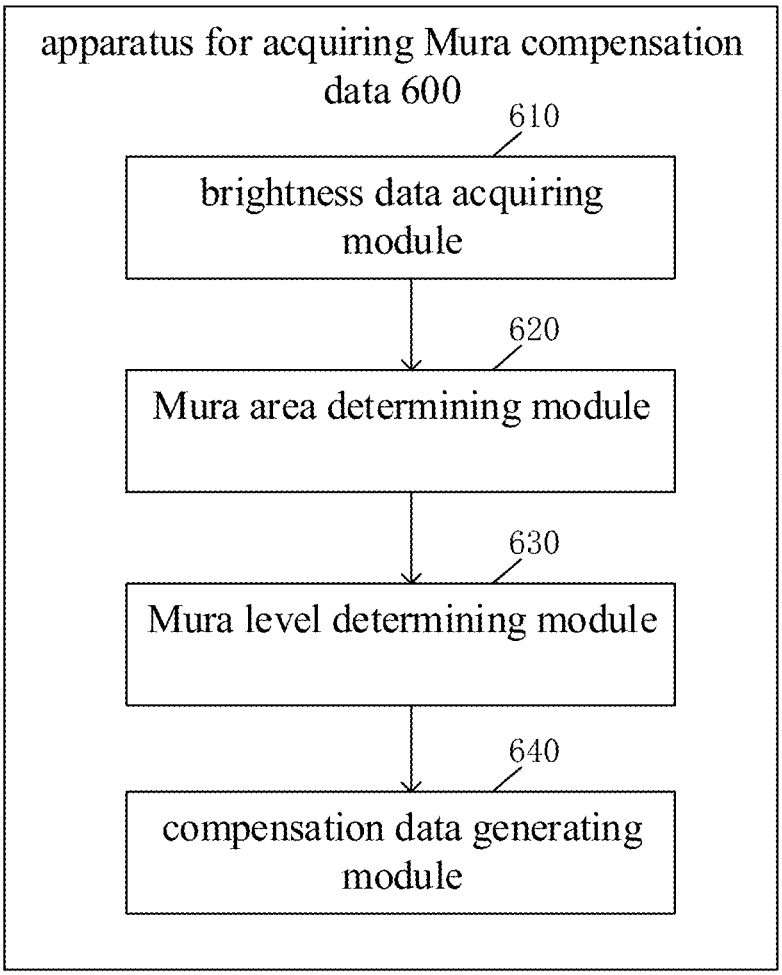
FIG. 6 is a structure block diagram of an apparatus for acquiring Mura compensation data in an exemplary embodiment.

In an embodiment, as shown in FIG. 6, an exemplary embodiment of the present disclosure provides an apparatus 600 for acquiring Mura compensation data, including: a brightness data acquiring module 610, a Mura area determining module 620, a Mura level determining module 630, and a compensation data generating module 640.

The brightness data acquiring module 610, or called as a brightness data acquiring circuit, is configured to acquire brightness data of a detection picture displayed by the display panel.

The Mura area determining module 620, or called as a Mura area determining circuit, is configured to determine one or more Mura areas in the display panel according to the brightness data of the detection picture.

The Mura level determining module 630, or called as a Mura level determining circuit, is configured to determine a Mura level respectively corresponding to each of the one or more Mura areas according to the brightness data corresponding to the one or more Mura areas and a preset Mura level threshold.

The compensation data generating module 640, or called as a compensation data generating circuit, is configured to generate compensation data corresponding to the display panel according to the Mura level respectively corresponding to each of the one or more Mura areas, the brightness data of the detection picture, and preset target brightness data.

For specific limitation of the apparatus for acquiring the Mura compensation data, reference may be made to the method for acquiring the Mura compensation data described above, and details are not described herein again. Each of the modules in above-described apparatus for acquiring Mura compensation data may be implemented in whole or in part by software, hardware, and combinations thereof. Each of the above modules may be embedded in or independent of the processor in the computer device in the form of hardware, or may be stored in the memory of the computer device in the form of software, so that the processor can call and execute the operation corresponding to the above each module.

Figure 7:
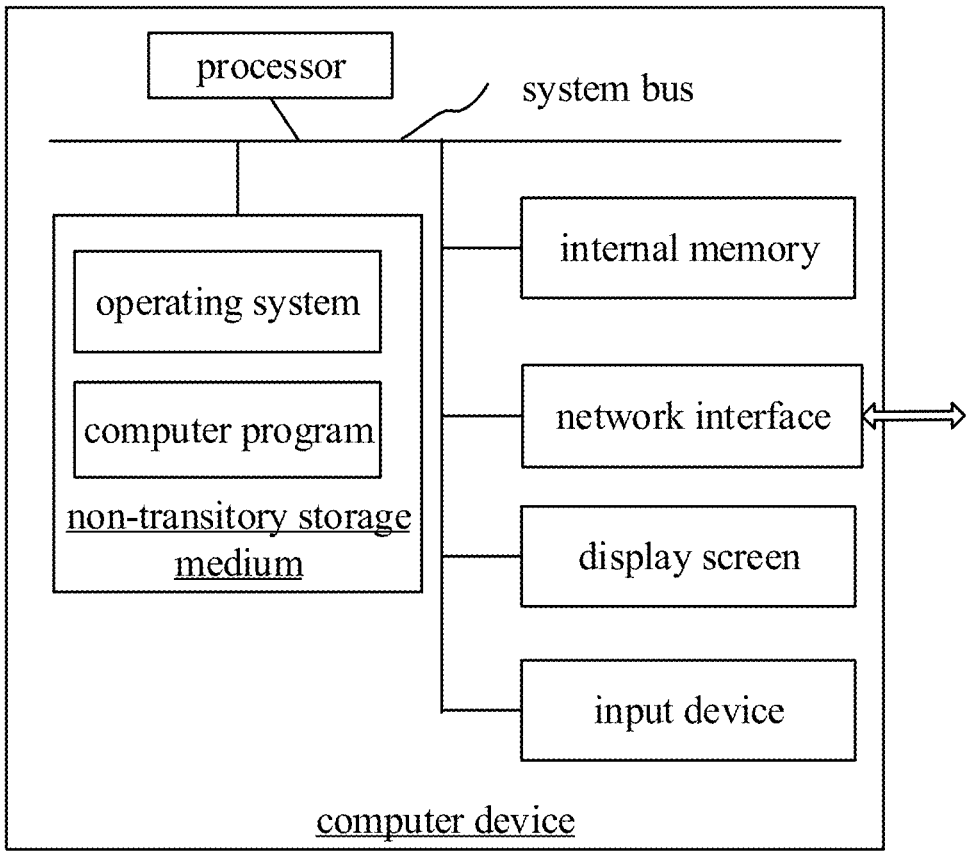
FIG. 7 is an internal structure diagram of a computer device in an exemplary embodiment.

An exemplary embodiment of the present disclosure provides a computer device, which may be a terminal, and an internal structure diagram thereof may be as shown in FIG. 7. The computer device includes a processor, a memory, a network interface, a display screen, and an input device connected by a system bus. The processor of the computer device is configured to provide computing and control capabilities. The memory of the computer device includes a non-transitory storage medium and an internal memory. The non-transitory storage medium stores an operating system and a computer program. The internal memory provides an environment for operation of the operating system and the computer program in the non-transitory storage medium. The network interface of the computer device is configured to communicate with an external terminal via a network connection. The computer program is executed by the processor to implement a method of acquiring Mura compensation data. The display screen of the computer device may be a liquid crystal display or an electronic ink display, and the input device of the computer device may be a touch layer covering on the display screen, or may be a button, a trackball or a touch pad provided on the housing of the computer device, or may be an external keyboard, a touch pad or a mouse.

It will be appreciated by those skilled in the art that the structure shown in FIG. 7 is only a block diagram of partial structure related to the solution of the exemplary embodiment of the present disclosure, and does not constitute a limitation of the computer device to which the solution of the present disclosure is applied. The specific computer device may include more or fewer components than those shown in the figures or combinations of some components, or have different component arrangements.

An exemplary embodiment of the present disclosure provides a computer device including a processor and a memory storing a computer program. The steps of the methods in the above-described embodiments are implemented when the processor executes the computer program.

Another exemplary embodiment of the present disclosure provides a computer readable storage medium on which a computer program is stored. The steps of the methods in the above-described embodiments are implemented when the computer program is executed by a processor.

It will be understood by a person of ordinary skill in the art that all or part of the flows in the methods of the above embodiments may be implemented by the computer programs to instruct the related hardware. The computer program can be stored in a non-transitory computer readable storage medium, and the flows of the embodiments of the above methods can be implemented when the computer programs are executed. Any reference to the memory, storage, database or other media used in various embodiments provided in the present disclosure may include non-transitory and/or transitory memory. A non-transitory memory may include a read only memory (ROM), programmable ROM (PROM), an electrically programmable ROM (EPROM), an electrically erasable programmable ROM (EEPROM) or a flash memory. A volatile memory may include a random access memory (RAM) or an external cache memory. By way of illustration and not limitation, a RAM is available in a variety of forms, such as a Static RAM (SRAM), a Dynamic RAM (DRAM), a Synchronous DRAM (SDRAM), a Dual Data Rate SDRAM (DDRSDRAM), an Enhanced SDRAM (ESDRAM), a Synchlink DRAM (SLDRAM), a Rambus Direct RAM (RDRAM), a Direct Rambus Dynamic RAM (DRDRAM), a Rambus Dynamic RAM (RDRAM), and the like.

Each technical feature of the above-described exemplary embodiments can be combined arbitrarily. In order to make the description concise, not all the possible combinations of the technical features in the above embodiments are described. However, all of the combinations of these technical features should be considered as within the scope of this disclosure, as long as such combinations do not contradict each other.

The above exemplary embodiments merely illustrate several embodiments of the present disclosure, and the description thereof is specific and detailed, but it shall not be constructed as limiting the scope of protection of the present disclosure. It should be noted that, for a person of ordinary skill in the art, several variations and improvements may be made without departing from the concept of the present disclosure, and these are all within the scope of protection of the present disclosure. Therefore, the scope of protection of the present disclosure shall be subject to the appended claims.

The invention claimed is:

1. A method for acquiring Mura compensation data, the method comprising:

acquiring brightness data of a detection picture displayed by a display panel;

determining one or more Mura areas in the display panel according to the brightness data of the detection picture, the Mura area comprising a plurality of pixels;

determining a Mura level respectively corresponding to each of the one or more Mura areas according to the brightness data corresponding to the one or more Mura areas and a preset Mura level threshold; and generating compensation data corresponding to the display panel according to the Mura level respectively corresponding to each of the one or more Mura areas, the brightness data of the detection picture, and preset target brightness data, comprising:

determining an algorithm corresponding to the each of the one or more Mura areas according to the Mura level respectively corresponding to the each of the one or more Mura areas;

determining a compression ratio respectively corresponding to the each of the one or more Mura areas according to the Mura level and the algorithm respectively corresponding to the each of the one or more Mura areas; and generating the compensation data corresponding to the display panel according to the algorithm, the brightness data of the detection picture, and the target brightness data.

2. The method according to claim 1, wherein the generating the compensation data corresponding to the display panel according to the algorithm, the brightness data of the detection picture, and the target brightness data comprises:

generating the compensation data corresponding to the display panel according to the algorithm, the compression ratio, the brightness data of the detection picture, and the target brightness data.

3. The method according to claim 2, wherein the greater the difference value between the brightness data of the each of the one or more Mura areas and the brightness average value, the higher the corresponding Mura level.

4. The method according to claim 1, wherein the compression ratio is negatively correlative with the Mura level corresponding to the each of the one or more Mura areas.

5. An apparatus for acquiring Mura compensation data, comprising:

a brightness data acquiring module, configured to acquire brightness data of a detection picture displayed by a display panel;

a Mura area determining module, configured to determine one or more Mura areas in the display panel according to the brightness data of the detection picture;

a Mura level determining module, configured to determine a Mura level respectively corresponding to each of the one or more Mura areas according to the brightness data corresponding to the one or more Mura areas and a preset Mura level threshold; and a compensation data generating module, configured to generate compensation data corresponding to the display panel according to the Mura level respectively corresponding to the each of the one or more Mura areas, the brightness data of the detection picture, and preset target brightness data, the compensation data being associated with a compression ratio of each of the one or more Mura areas.

6. A computer device comprising a processor and a non-transitory computer readable storage medium, wherein, when executed by the processor, cause the processor to implement a method for acquiring Mura compensation data, the method comprising:

acquiring brightness data of a detection picture displayed by a display panel;

determining one or more Mura areas in the display panel according to the brightness data of the detection picture;

determining a Mura level respectively corresponding to each of the one or more Mura areas according to the brightness data corresponding to the one or more Mura areas and a preset Mura level threshold; and generating compensation data corresponding to the display panel according to the Mura level respectively corresponding to each of the one or more Mura areas, the brightness data of the detection picture, and preset target brightness data, the compensation data being associated with a compression ratio of each of the one or more Mura areas.

* * * * *